United States Patent [19]

Bogdanow

[11] Patent Number: 5,060,435

[45] Date of Patent: Oct. 29, 1991

[54] BRACKET FOR SUPPORT OF VERTICAL POLE

[76] Inventor: Anatol L. Bogdanow, P.O. Box 27, New Market, Ontario, Canada, L3Y 4W3

[21] Appl. No.: 480,566

[22] Filed: Feb. 15, 1990

[51] Int. Cl.[5] ..... E04H 12/08

[52] U.S. Cl. ..... 52/292; 52/298; 52/165

[58] Field of Search ..... 52/165, 156, 298, 292

[56] References Cited

U.S. PATENT DOCUMENTS

| | | | |
|---|---|---|---|
| 1,438,074 | 12/1922 | Welch | 52/165 |
| 1,486,594 | 3/1924 | Malone | 52/298 |
| 1,846,650 | 2/1932 | Olson | 52/298 |
| 3,514,911 | 6/1970 | Preradovich | 52/298 |
| 4,218,858 | 8/1980 | Legler | 52/165 |

FOREIGN PATENT DOCUMENTS

| | | | |
|---|---|---|---|
| 86144 | 4/1921 | Austria | 52/298 |

*Primary Examiner*—David A. Scherbel

*Assistant Examiner*—Joanne C. Downs

*Attorney, Agent, or Firm*—Fidelman & Wolffe

[57] ABSTRACT

The bracket anchors a hydro pole or a telephone pole vertically on rocky ground or on ground beneath which are sewer pipes or electrical conduits. The bracket consists of a number of pole-mounts each having a base which rests on the ground and an upright which contacts the pole. The pole-mounts are spaced about the circumference of the pole and are clamped to the pole by means of bands interconnected by links. The length of each link is adjustable to fit poles of various sizes.

A leg extends downwardly from the pole-mount into a hole in the ground. The leg consists of a sleeve to which a number of wedges are connected. A bolt extends downwardly from the base of the pole-mount into the sleeve and mates threadably with a camming plug. Rotation of the bolt causes the plug to move upwardly into contact with the wedges and to force them outward into contact with the inside wall of the hole with resulting anchoring of the leg in the hole.

10 Claims, 6 Drawing Sheets

BRACKET FOR SUPPORT OF VERTICAL POLE

CROSS REFERENCES TO PRIOR ART

U.S. Pat. No. 927,064—Expansion Bolt. H. W. Mower issued July 6, 1909.

U.S. Pat. No. 1,869,877—Pole Fitting. A. O. Austin issued Aug. 2, 1932.

U.S. Pat. No. 2,183,551—Hose Clamp. A. L. Dold issued Dec. 19, 1939.

U.S. Pat. No. 2,241,343—Expansion Shell for Machine Bolts. J. Fleaca issued May 6, 1941.

U.S. Pat. No. 2,626,023—Drill Post. E. B. Lear issued Jan. 20, 1953.

U.S. Pat. No. 2,642,768—Rock Anchor. H. R. Ogburn issued June 23, 1953.

U.S. Pat. No. 2,900,698—Quick Acting Hose Clamp. H. P. Zartler issued Aug. 25, 1959.

U.S. Pat. No. 3,187,858—Anchoring Device. N. H. des Champs issued June 8, 1965.

U.S. Pat. No. 3,413,693—Clamping Collar. C. F. Tonnelline issued Dec. 3, 1968.

U.S. Pat. No. 3,514,911—Line Pole Rock Anchor Brackets. R. N. Preradovich issued June 2, 1970.

U.S. Pat. No. 3,747,468—Anchor Bolt. J. W. Jansen et al. issued July 24, 1973.

U.S. Pat. No. 3,993,341—Deck Structure and Connector for Building Construction. C. A. Bentley issued Nov. 23, 1976.

U.S. Pat. No. 4,160,614—Expansion Shell Assembly and Method for Combining Resin Bonding and Mechanical Anchoring of a Bolt in a Rock Formation. S. F. Koval issued July 10, 1979.

U.S. Pat. No. 4,218,858—Tri-Anchor Bracket for Poles. S. Legler issued Aug. 26, 1980.

U.S. Pat. No. 4,362,440—Tubular Lost Borehold Closure. O. -E. Gllaesmann et al. issued Dec. 7, 1982.

BACKGROUND OF THE INVENTION

This invention relates to brackets for anchoring poles such as hydro or telephone poles upright on the ground and more particularly to brackets suitable for anchoring poles in rocky, rugged terrain where the surfaces on which the poles rest need not be horizontal or on ground beneath which sewage or electrical conduits are located where the location of the anchoring means for the brackets is extremely restricted.

Various brackets are known for maintaining poles vertical on rocky ground. The brackets are connected to anchor bolts which are secured in holes drilled in the ground adjacent to where the pole is to stand. Preradovich U.S. Pat. No. 3,514,911 and Legler U.S. Pat. No. 4,218,858 both referred to above, describe brackets suitable for this purpose.

A shortcoming of known brackets such as those described in the patents referred to above is that they are generally unsuitable where the holes in which the anchor bolts are secured are inaccurately located. Should for example those holes not extend exactly vertically downward it is not possible to tighten the anchor bolts in the holes except with the greatest of difficulty. Similarly if the holes are not spaced apart from the poles an exact predetermined distance, the brackets cannot be secured in such a way as to minimize lateral movement of the pole after the pole is attached to it.

The reason why the holes must be accurately located is because the brackets are held in position by elongated bolts which extend downwardly through sleeves in the brackets and into the holes. The bolts must be rotated in order to fasten them in the holes. Should the holes not be accurately located the bolts must be bent to fit into those holes. The greater the amount of bend the more difficult it is to rotate the bolts. In fact it is altogether impossible to rotate the bolts should the amount of bend be too great.

SUMMARY OF THE INVENTION

It is an object of this invention to provide a bracket which is suitable for supporting a pole in the most rugged, rocky country where the unevenness and the nature of the terrain makes it difficult if not impossible to drill holes which are exactly vertical or which are accurately placed in relation to the intended location of the pole. Moreover the bracket may be used to support a pole where the ground beneath it is occupied by a sewage system or by underground cables.

It is another object of this invention to provide brackets which will support poles on ground which is not level. Moreover wide latitude in the location and the orientation of the holes is possible so that the holes can be located primarily where the anchor bolts will be best secured and only secondarily where the pole is to stand.

Another object of this invention is to provide a clamp which is suitable for attaching the brackets to poles of a wide variation in sizes.

A still further object of the invention is provide a template for facilitating the location of the holes to be drilled.

These and other objects are accomplished by a bracket for anchoring a pole vertically on a rock-like support surface comprising: a plurality of pole-mounts having a base for resting on the support surface and a vertically upwardly extending upright which contacts the pole; clamping means for clamping the pole-mount to the pole; a leg which extends downwardly from the pole-mount for insertion into a hole which extends downwardly from the support surface, the leg including a sleeve, an inner member and expandible means, the sleeve having an upper end connectable to the base and extending downwardly therefrom, the inner member being movable within and relative to the sleeve, and when so moved causing lateral expansion of the expandible means with resulting anchoring of the leg in the hole.

DESCRIPTION OF THE DRAWINGS

The invention is described in detail with reference to the accompanying drawings in which.

Like reference characters refer to like parts throughout the description of the drawings.

DESCRIPTION OF THE PREFERRED EMBODIMENT

Figure 1:
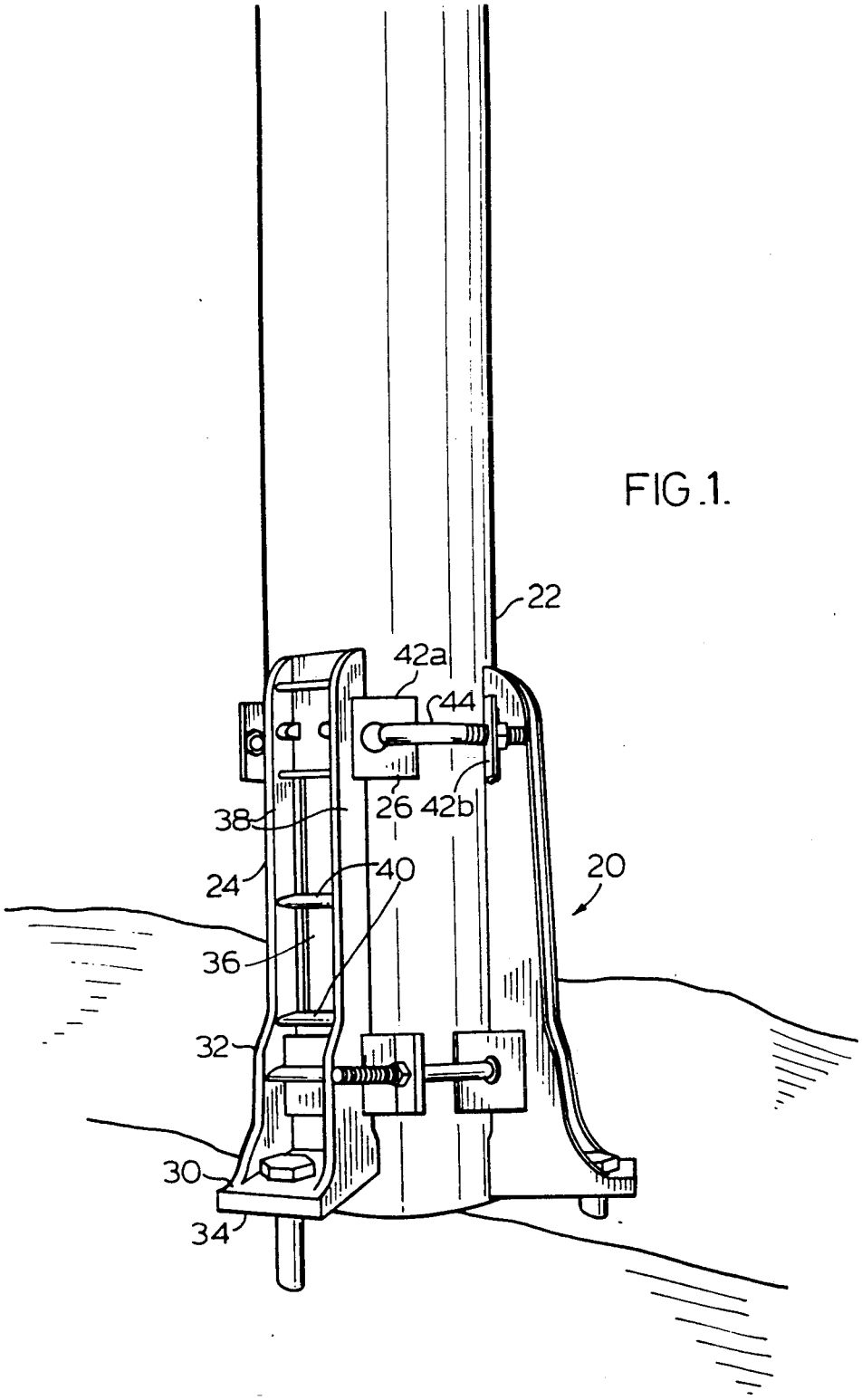
FIG. 1 is a perspective view of the bracket of the invention in conjunction with a hydro or telephone pole.

With reference to FIG. 1, the bracket of the invention, generally 20, is shown in conjunction with a hydro or telephone pole 22. The bracket includes a pole-mount 24 and a pair of spaced clamps 26.

The pole-mount is made up of a base 30 and an upright 32. The base is vertically extending and has an under surface 34 which rests on the ground or other support surface for the pole. The upright has a generally U shaped cross section and is made up of a central web 36 which contacts the pole and two spaced flanges 38 which extend at generally right angles from the two side edges of the web. A number of vertically spaced reinforcing ribs 40 extend between the flanges.

With reference to FIG. 1, each clamp 26 is made up of a pair of bands 42*a*, *b* which are attached to the exterior flange walls and which extend circumferentially around the pole. An aperture is formed in each band and a link 44 extends between the bands and its ends pass through the apertures.

Figure 2:
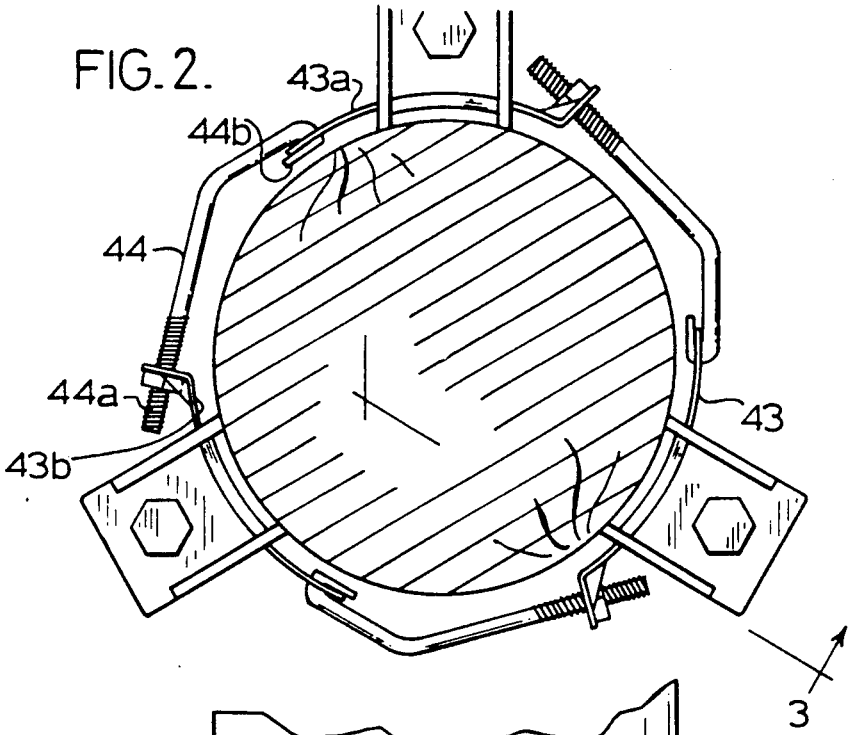
FIG. 2 is a plan view of the bracket and pole.
Figure 3:
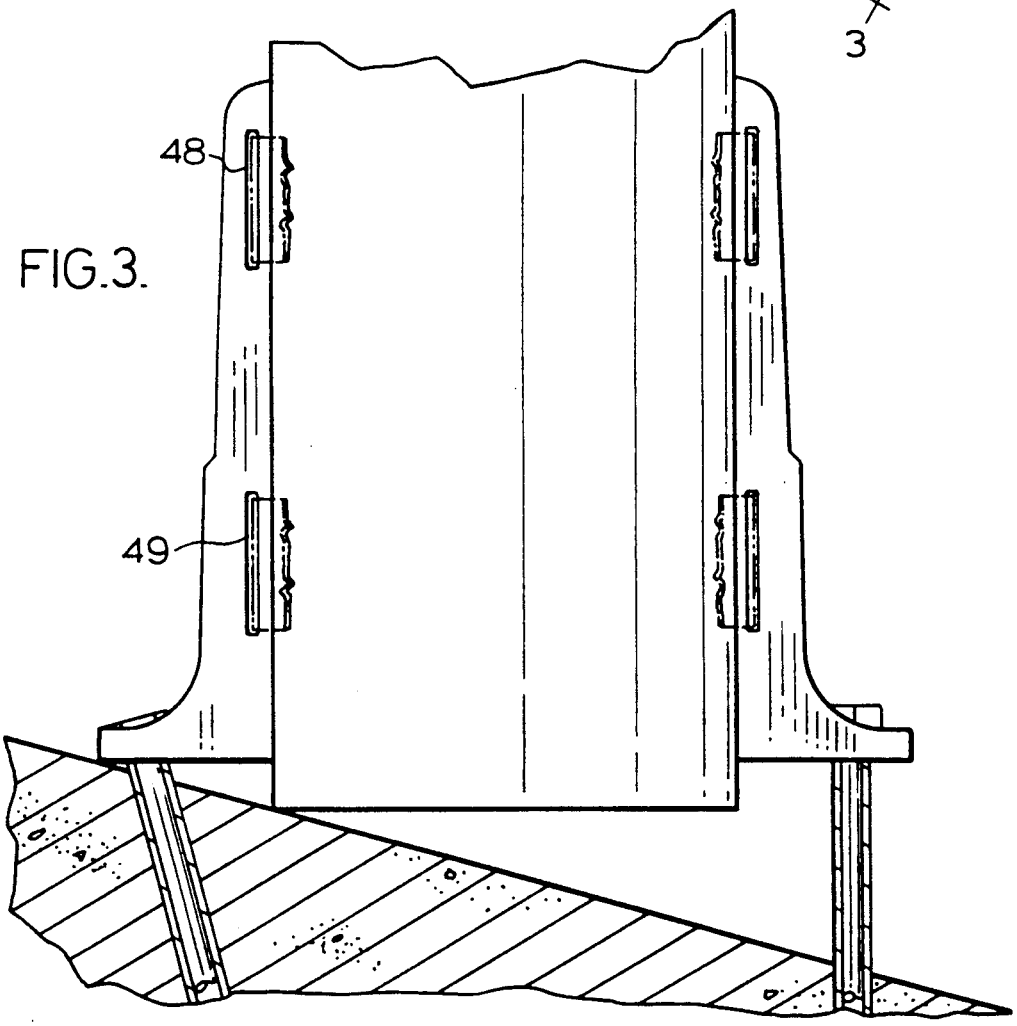
FIG. 3 is an elevation, partly in section, on lines 3—3 of FIG. 2.
Figure 9:
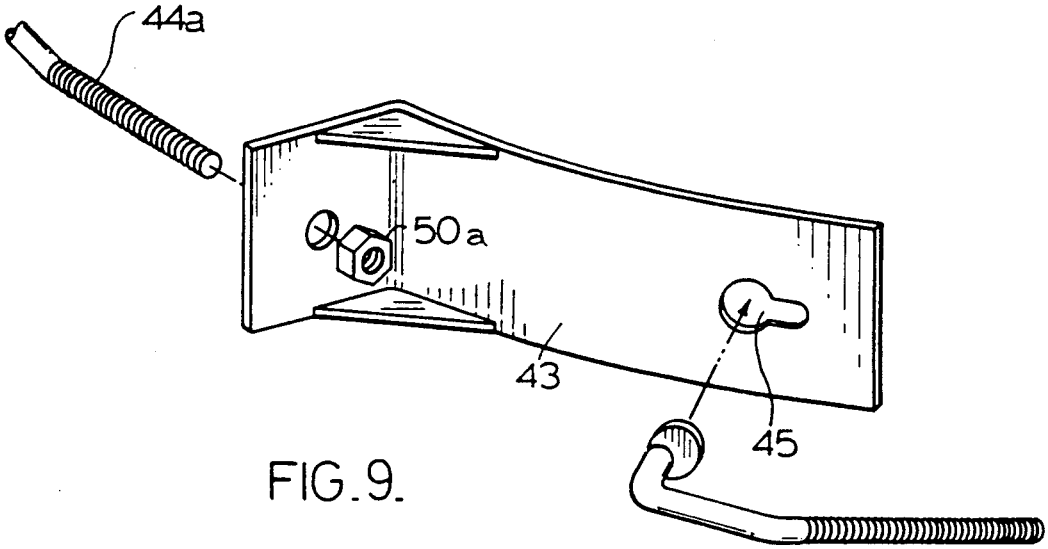
FIG. 9 is a perspective view of the components of the bracket used for connection to the pole.

The bands may be attached to the pole-mounts by welding or they may be bolted to them. Alternatively as illustrated in FIGS. 2, 3 and 9, the bands 43 pass through slots 48, 49 in the two flanges of the mount and extend outwardly from opposite sides of the same mount. Where the bands are so formed, they are free to slide horizontally in the slots in the pole-mounts.

With further reference to FIGS. 2 and 9, link 44 is in the form of a bent rod having a threaded end portion 44*a*. The opposite end 44*b* has a forged offset head or hook 44*b* which is removably accommodated in a key-hole 45 formed in band 43*a*. The threaded end of the link is inserted in the aperture formed in band 43*b*. A nut 50*a* prevents the threaded end from being removed from the band. The key-hole shape ensures that the rod will not become disconnected from the band when assembled as illustrated in FIG. 2.

When the links are so assembled, the links, the bands and the pole-mounts together extend around the entire circumference of the pole. The assembly restrains the pole from movement and the pole is thus anchored in position. There is no need to use lag bolts to prevent the pole-mounts from turning with respect to the pole.

Figure 4:
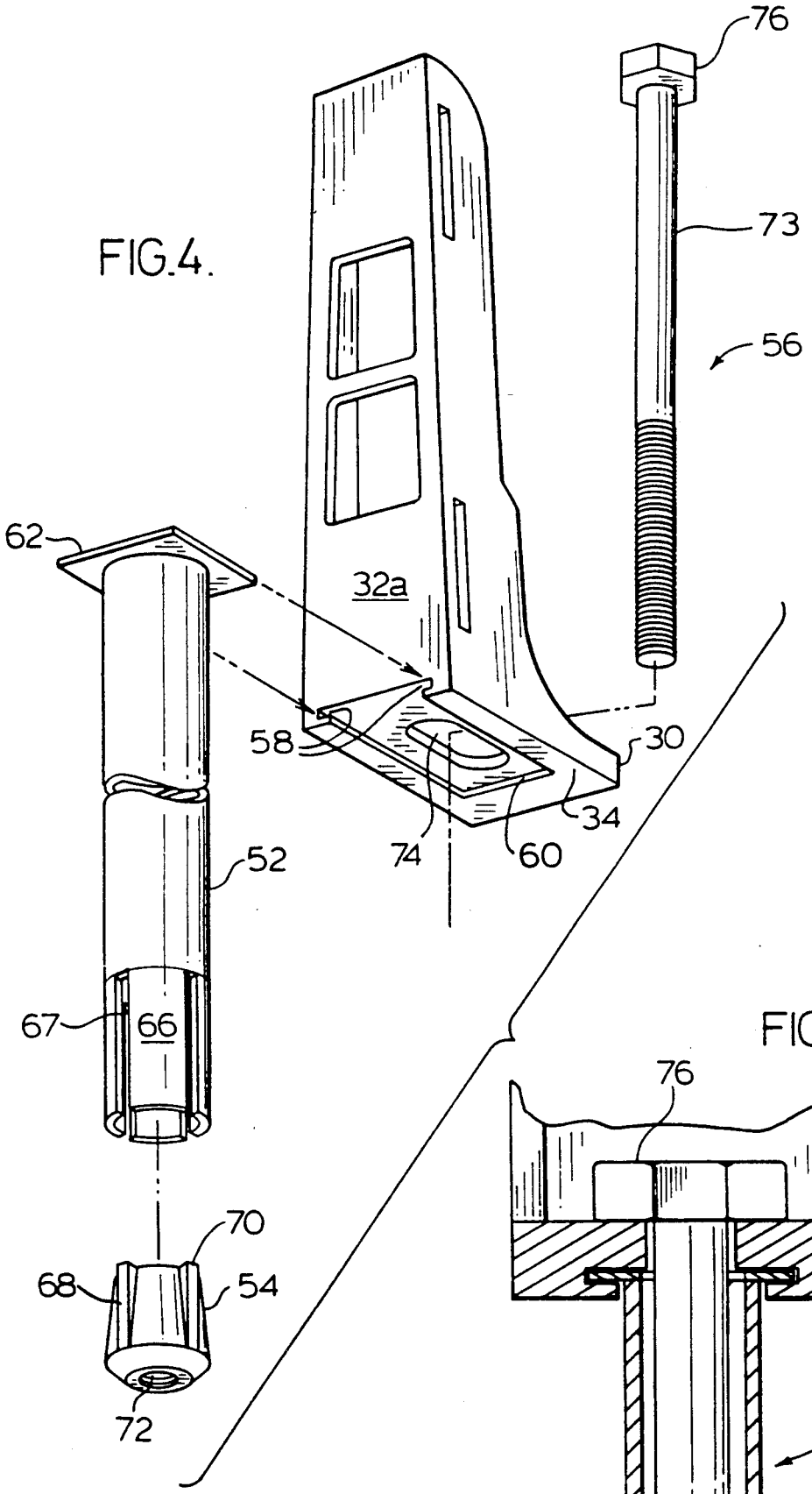
FIG. 4 is an exploded perspective view of the components of the bracket of the invention.
Figure 5:
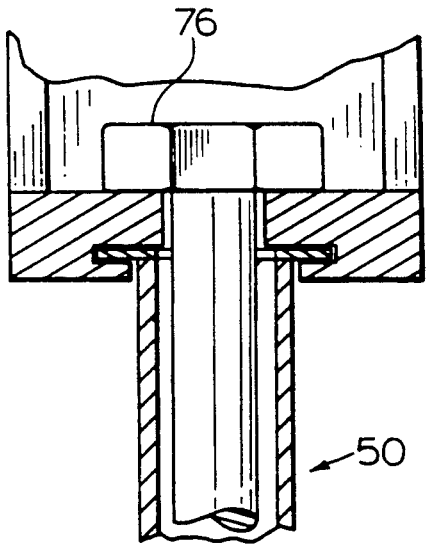
FIG. 5 is a fragmentary elevation, partly in section, of the components of the bracket in an assembled state.

With reference to FIGS. 4 and 5, the pole-mount is shown in conjunction with the components which together form a leg for anchoring the pole-mount to the ground. The leg, generally 50, is made up of a sleeve 52, a camming plug 54 and an inner member or bolt, generally 56. A pair of horizontally spaced parallel slots 58 are formed on the under surface 34 of the pole-mount. The slots commence at the wall 32*a* of the upright 32 which faces the pole and extend at generally right angles to that wall. The slots terminate at a stop 60. The slots removably accommodate opposite edges of a plate 62 which is attached to the upper wall of sleeve 52.

Figure 6:
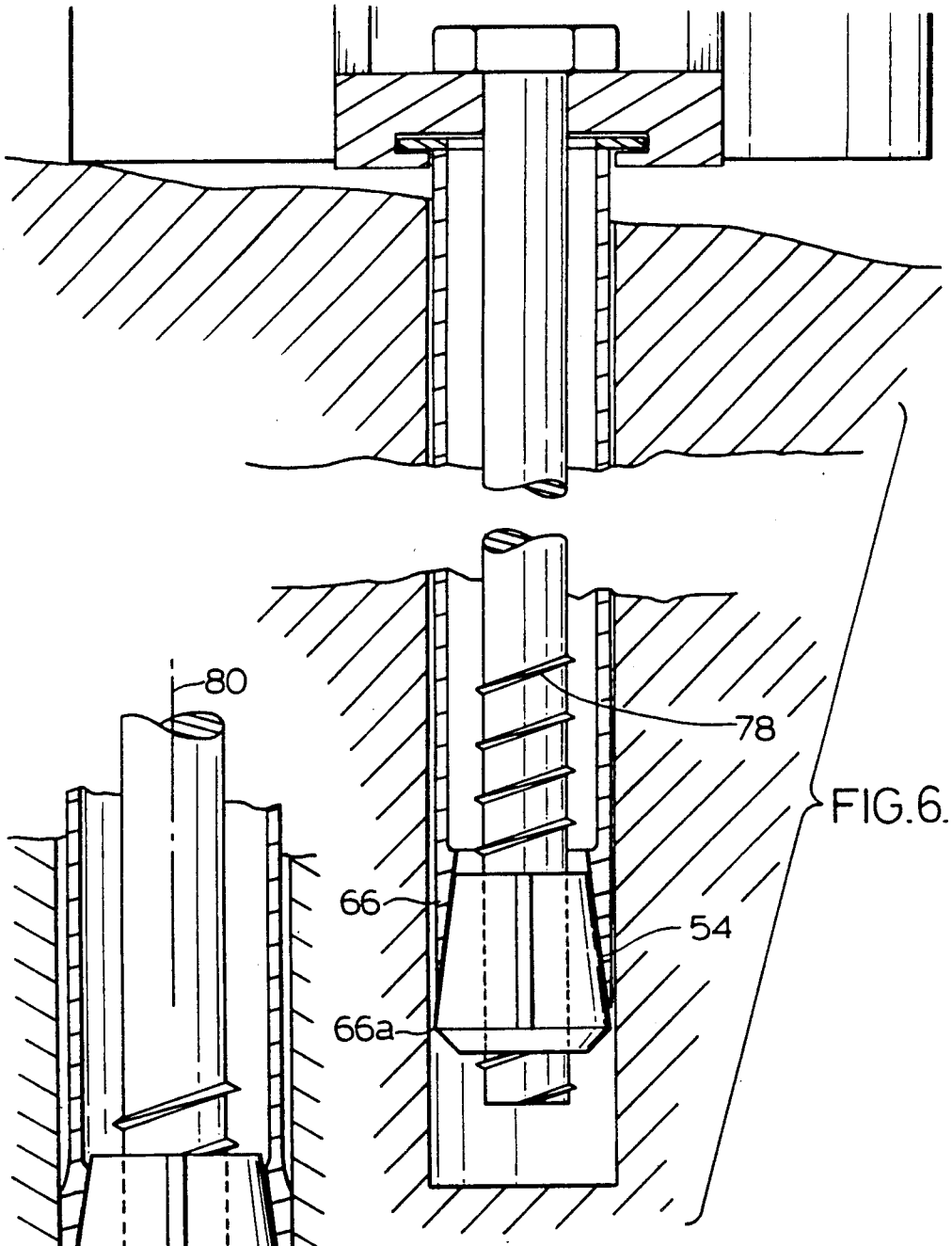
FIG. 6 is an other elevation, partly in section, of the assembled components.
Figure 7:
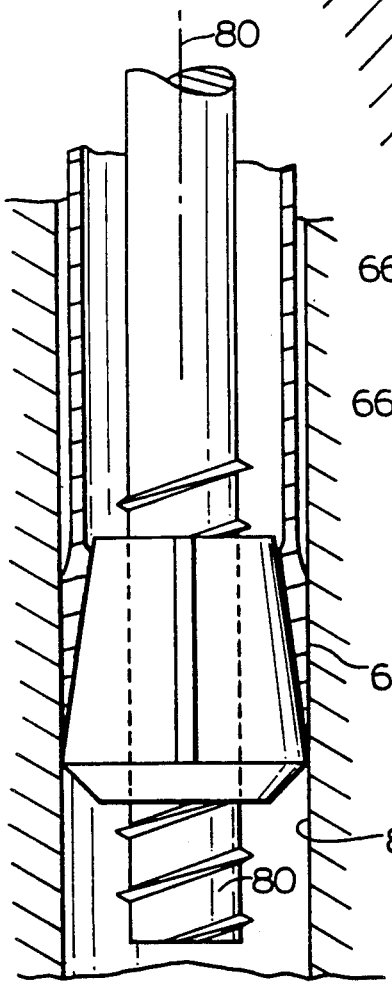
FIG. 7 is an elevation, partly in section, of the lower end of the bracket.

Connected to the lower end of the sleeve by, for example, welding are circumferentially arranged segments 66, the outer diameter of which being the same as that of the sleeve to which the segments are attached. A space or slot 67 is between adjacent segments. As illustrated in FIGS. 6 and 7, each segment is shaped in the form of an wedge which opens upwardly and inwardly i.e. the wedge is thinnest at its lower edge 66*a* and thickens upwardly. Those segments constitute expandible means for engaging the wall of the hole in which the sleeve is inserted. The way in which they do so is described below.

Camming plug 54 serves to urge the segments 66 between the slots outwardly or to expand. The plug has a frustoconical outer wall of the same slope as that of the inner wall of the segments. A number of ribs 68 are formed on its outer wall. The number of ribs is the same as the number of slots 67. The width of the ribs is slightly less than the width of the slots and the ribs are so arranged that each will fit into a separate slot. As a result the plug can be positioned concentrically within the sleeve.

The outer diameter of the conical wall of the plug at its upper wall 70 is slightly greater than the inside diameter of the segments. The conical wall of the plug enlarges downwardly and, at its lower wall, its outer diameter exceeds the inside diameter of the segments. The outer diameter of the ribs is the same from the upper to the lower walls of the plug. A threaded bore 72 extends along the longitudinal axis of the plug.

Bolt 56 has a shank 73 which removably passes through an enlarged aperture 74 in base 30 and downwardly through the sleeve. As illustrated in FIG. 5, head 76 of the bolt has an outer diameter which is larger than the width of the aperture so that it cannot pass through the aperture.

With reference to FIG. 6 and 7, the lower portion of the shank is threaded at 78 and those threads mate threadably with the threads in the bore of plug 54. The ribs 68 of the plug are in the slots between segments 66 and will prevent the plug from rotating as the bolt is rotated. Rotation of the bolt will accordingly cause the plug to rise on the shank of the bolt from the position shown in FIG. 6 to the position shown in FIG. 7, In the latter figure, the conical wall of the plug which contacts the inside wall of the segments causes them to move radially outwardly of the longitudinal axis 80—80 of the sleeve and into contact with the wall 82 of the hole in which the sleeve is located.

Further upward movement of the plug causes the segments to more firmly contact the inside wall of the hole and to cause the sleeve to become more and more solidly anchored in the hole.

Figure 8:
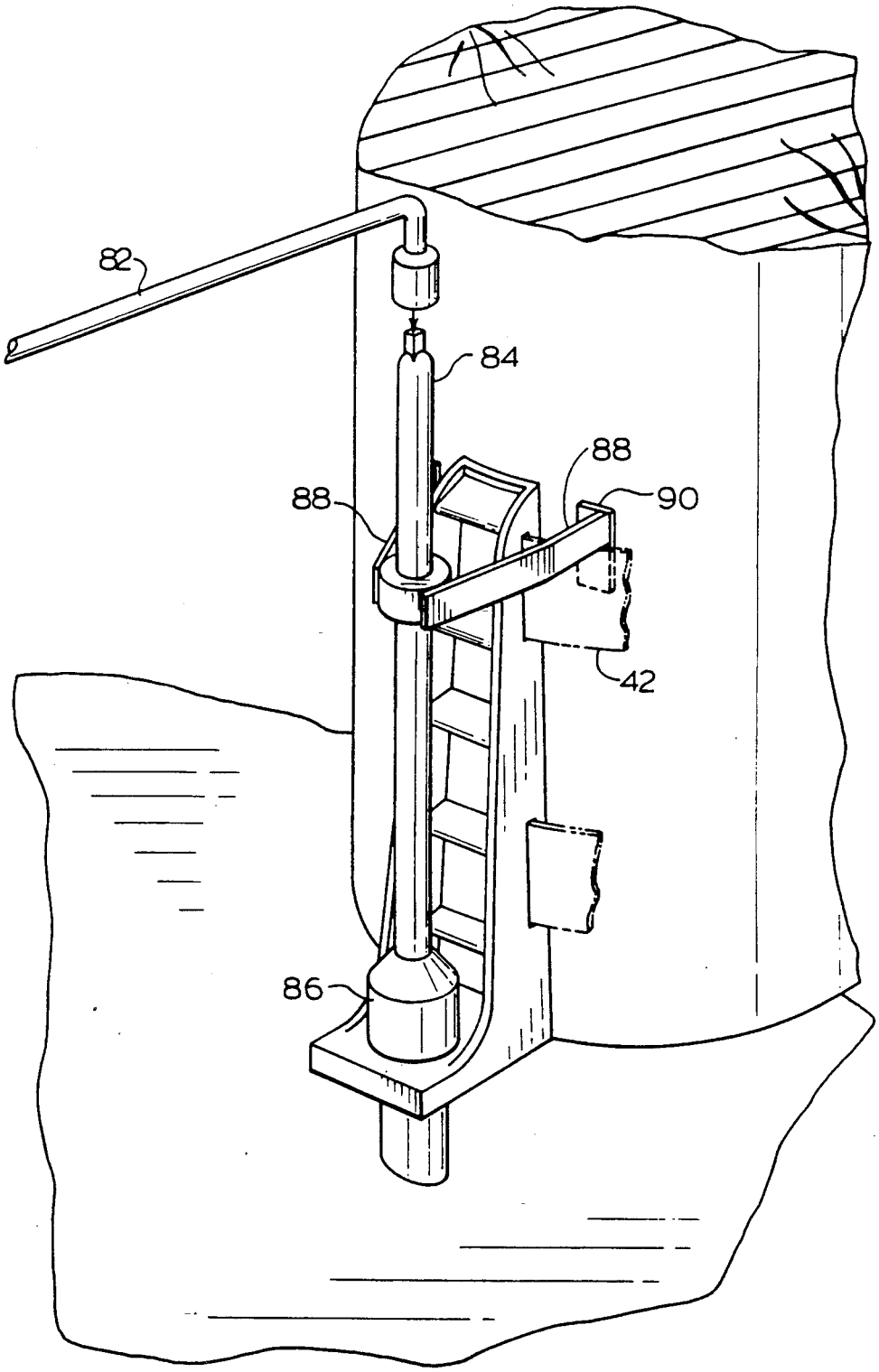
FIG. 8 is a perspective view of the bracket, pole and a ratchet and socket extension used in the installation of the bracket.

With reference to FIG. 8, bolt 56 is rotated by oscillation of handle or ratchet 82 which is removably connected to the upper end of a socket extension 84. A socket 86 at the lower end engages the head of the bolt and causes it to rotate when the handle is oscillated.

The socket extension is prevented from rocking or swaying when it is being rotated by means of pair of arms 88 which apply an inward pressure against diameterically opposite sides of an enlarged portion of the socket extension. The ends of the arms remote from the socket extension are attached to tabs 90 which fit snugly into the space between the bands 42 and the pole. The tabs can be withdrawn from the space and the socket and socket extension are removed after the bolt has been tightened sufficiently to anchor the sleeve in the hole.

Figure 10:
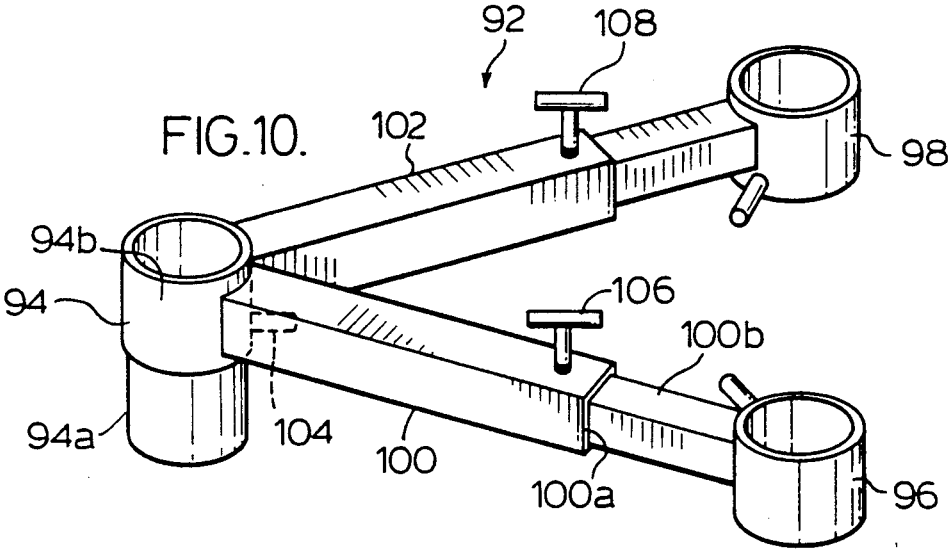
FIG. 10 is a perspective view of a template used in the attachment of the bracket.

With reference to FIG. 10, a template, generally 92, facilitates the location of the holes to be drilled where the pole is to be anchored by means of three brackets. The template consists of three sleeves 94, 96 and 98. Sleeve 94 consiste of a lower segment 94*a* of outside diameter slightly less than the diameter of the hole which is to be drilled and an upper segment 94*b* of greater diameter. The other two sleeves 96, 98 have uniform cross-sections throughout their lengths.

An expandible arm 100 extends between sleeves 94 and 96 and a like arm 102 extends between sleeves 94 and 98. As illustrated the longitudinal axes of both arms are oriented at right angles to the longitudinal axes of the sleeves and the angle between the axes of the arms is approximately 60 degrees.

A stud 104 extends inward from each sleeve. The length of the stud determines the distance of the hole from the pole in the manner described below.

Arm 100 consists of a hollow rectangular first section 100*a* which is attached to sleeve 94. A second rectangular section 100*b* is connected to sleeve 96 and is slidingly received in the hollow interior of section 100*a*. By means of set screw 106 the two sections can be locked together in any desired position. The position of sleeve 94 relative to sleeve 96 can accordingly be increased or decreased.

The construction of arm 102 is the same and its length can likewise be adjusted by means of set screw 108.

Figure 11:
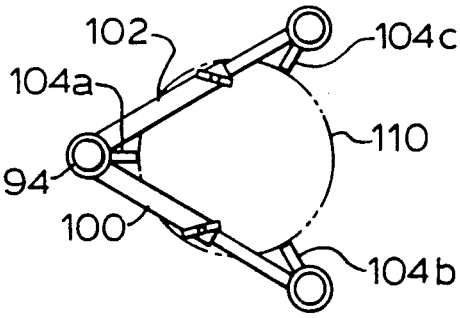
FIGS. 11 and 12 are two plan views of the template in conjunction with a pole.
Figure 12:
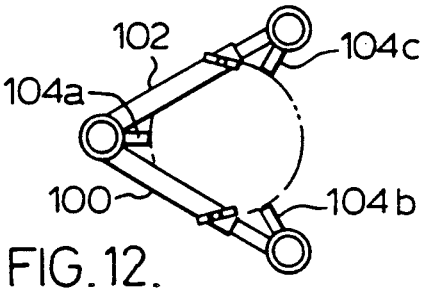

FIGS. 11 and 12 illustrate the manner in which the template can be used to locate the position of the holes which must be drilled in the ground. First a hole is drilled beside the place where the pole is to stand. Secondly while the pole is resting horizontally on the ground the template is placed beside the lower end of the pole such that the pole is between its arms as illustrated in those Figures. Thirdly the two set screws are loosened to allow the length of the arms to be adjusted until the studs 104*b* and 104*c* contact the outside wall of the pole portion. The template is then separated from the pole by moving it to the end of the pole.

The lower segment of sleeve 94 is then inserted into the hole that was drilled in the ground. The upper segment which has an outside diameter greater than the cross-section of the hole will remain on top of the hole. Two more holes are then drilled using the other two sleeves as guides. The three holes will be correctly located according to the size of the pole.

In FIG. 12 the pole has a smaller outside diameter than the pole illustrated in FIG. 11 and the length of arms 100 and 102 are correspondingly shorter to reflect the smaller diameter.

The holes which are drilled must have a cross-sectional area slightly greater than that of the outside wall of the sleeves so that the sleeves can be easily inserted into the holes. After the holes have been drilled and before the pole is moved into position for anchoring, one sleeve is attached to a pole-mount by inserting its plate 62 into slots 58 so that the sleeve and mount are connected as illustrated in FIG. 5.

Bolt 56 is then inserted downwardly through the aperture 74 of the pole-mount and through the central bore of the sleeve and while the sleeve and the mount are outside the hole the plug is turned onto the lower end of the bolt and the bolt is rotated until the upper ends of its ribs are just within slots 64 of the sleeve. The assembly is then inserted into the hole.

The pole is then raised by some suitable means such as by a mobile crane and is positioned upright beside the pole-mount. The other two pole-mounts are then connected to the legs in the manner described above and are placed in position adjacent to the other two holes. The three mounts must be at the same level and shims may be used for this purpose. The three pole-mounts are then interconnected by means of clamp 26.

The three mounts may then be anchored by tightening the bolts connected to each by means of the socket assembly 82, 84 and 86 with resulting stabilization and anchoring of the pole in an upright position. Should the wall of the holes crumble, the mounts will not be satisfactorily anchored. In such case, the mounts must be moved to a new location where they can be properly anchored.

Once the pole-mounts are properly anchored, grouting of the holes is not necessary since the strength of the installation depends only on the jamming action of the segments in the holes.

With reference to FIG. 3, it will be observed that the ground on which the pole is mounted is not horizontal and the hole in which one leg is located is not vertical. All that is required is that the pole-mounts be anchored in the ground by means of legs 50. When the pole is to be mounted on uneven ground the pole-mounts should be shimmed up with rocks so that the bands of the clamps are horizontal. After the pole is clamped to the assembly, the shims may be removed since the pole is supported by the pole-mounts and legs and not by the weight of the pole on the ground. Backfilling or grouting of the holes in which the legs are located are not necessary.

Since the bracket of the invention does not require any grout or cement to maintain it in position, the bracket may be removed after use. To do so, the pole must be held upright by means of, for example, a crane and the three bolts must be loosened. As the bolts are loosened, the bolt head will move upward from the base of the bracket. A sharp blow to the bolt head will move the bolt downward and release the camming plug from the segments 66 of the sleeve. The entire assembly can then be lifted easily from the hole.

The bracket of the invention is designed to allow for variations in the size of the outer diameter of the pole. As illustrated in FIG. 4, aperture 74 in the base of the pole-mount is elongated and allows the pole-mount to be moved backward and forward to accommodate poles of larger or smaller diameter. In addition by reason of the elongated apertures, the leg to which the pole is attached need not be vertical. The aperture allows the bolt which passes through it to be oriented in different directions. FIG. 3 illustrates this.

The clamp can likewise accommodate poles of different diameters. As illustrated in FIG. 2, the effective length of each link can be changed by means of the nut which is turned on its threaded end portion. By advancing the nut toward the hook, for example, the effective length of the link is shortened. When the link is in the assembly illustrated in FIG. 2, the area bounded by the links and bands is reduced as the effective length of the links is reduced. Conversely the area is increased so that a pole of larger diameter can be accommodated simply by increasing the effective length of each link in the assembly.

In the event that the links cannot be lengthened sufficiently to accommodate a large pole all that is necessary is to substitute longer links for the existing links in the assembly of links and bands.

It will be understood from the foregoing that the pole-mount of the invention will accommodate all sizes of poles normally encountered in practice as will the bands of the clamp. The only component that may not accommodate poles of all sizes is the link. For that reason it is advisable on a job site to stock links of different sizes. However because of the adjustability of the links very few different sizes of links are necessary.

In general it is preferable for the pole-mounts which support a pole to be about 120 degrees apart. However this is not essential. Where the terrain makes this impossible the design of the clamps is such that the spacing between adjacent pole-mounts can be adjusted according to the spacing between pole-mounts. It is not necessary that the effective length of the links in an assembly of links and bands be the same.

Preferably the pole-mount and the camming plug are cast in malleable iron and the clamps and the remaining components of the legs are formed of galvanized steel.

It will be understood of course that modifications can be made in the preferred embodiment described herein without departing from the scope and purview of the invention as defined in the appended claims.

The embodiments of the invention in which an exclusive property or privilege is claimed are defined as follows:

1. A bracket for anchoring a pole vertically on a support surface comprising: pole-mount having a base for resting on the support surface and a vertically upwardly extending upright which contacts said pole, said base having a lower surface; clamping means for clamping said pole-mount to said pole; a leg which extends downwardly from said pole-mount for insertion into a hole which extends downwardly from said support surface, said leg including a sleeve, an inner member and expandible means, said sleeve having an upper end connectable to said base and extending downwardly therefrom, said inner member being movable within and relative to said sleeve and when so moved causing lateral expansion of said expandible means with resulting anchoring of said leg in the hole.

2. The bracket as claimed in claim 1 further including a plate formed at the upper end of said sleeve, said base having a pair of spaced apart slots formed on the lower surface thereof for removable accommodation of said plate.

3. The bracket as claimed in claim 1 where said expandible means comprises a plurality of wedges having lower edges being thinnest at their lower edges and thickening upwardly.

4. The bracket as claimed in claim 1 wherein said clamping means comprises a link having a hook at one end which is removably connected to a first pole-mount and a threaded end at the other end which passes through an aperture in a second pole-mount adjacent to said first pole-mount and which is secured therein by threaded means.

5. A bracket for anchoring a pole vertically on a rock-like support surface comprising: a plurality of pole-mounts each having a base for resting on the support surface and a vertically upwardly extending upright which contacts said pole, said base having a lower surface; clamping means for clamping said pole-mount to said pole; a leg which extends downwardly from said pole-mount, each leg having a free lower end portion and which includes a sleeve and an inner member, said sleeve having an upper end connectable to said base and extending downwardly therefrom, said inner member being movable within and relative to said sleeve, the free lower end portion of each leg remote from the pole-mount having means laterally expandible by said relative movement such that said leg can be anchored in a hole which extends downwardly from said support surface.

6. The bracket as claimed in claim 5, further including a plate formed at the upper end of said sleeve, said base having a pair of spaced apart slots formed on the lower surface thereof for removable accommodation of said plate.

7. The bracket as claimed in claim 5, wherein said expandable means comprises a plurality of wedges having lower edges being thinnest at their lower edges and thickening upwardly.

8. The bracket as claimed in claim 5, wherein said clamping means comprises a link having hook at one end which is removably connected to a first pole-mount and a threaded end at the other end which passes through an aperture in a second pole-mount adjacent to said first pole-mount and which is secured therein by threaded means.

9. The bracket as claimed in claim 5, wherein said clamping means comprises a clamp including a link having a hook at one end for removable interconnection to a first pole-mount, said link further including a threaded portion adjacent to an opposite end thereof for threadable connection to a second pole-mount.

10. The bracket as claimed in claim 9, further comprising a plurality of bands which extend circumferentially around said pole and which pass through slots formed in said pole-mounts, each of said bands having a first aperture formed in a first end thereof and a second aperture formed in a second end thereof, the hook of a first link being accommodated in said first aperture and the threaded portion of a second link being accommodated in said second aperture, and means for removably maintaining the threaded portion in said aperture.

* * * * *